US006502708B2

(12) United States Patent
Daniel

(10) Patent No.: US 6,502,708 B2
(45) Date of Patent: Jan. 7, 2003

(54) MODULAR STORAGE ASSEMBLY FOR MINIATURE TOY COLLECTION

(76) Inventor: Susan W. Daniel, 3044 Sabine Hill Ave., Henderson, NV (US) 89052

( * ) Notice: Subject to any disclaimer, the term of this patent is extended or adjusted under 35 U.S.C. 154(b) by 0 days.

(21) Appl. No.: 09/797,072

(22) Filed: Feb. 27, 2001

(65) Prior Publication Data

US 2002/0117463 A1 Aug. 29, 2002

(51) Int. Cl.[7] ..... A63H 33/08

(52) U.S. Cl. ..... 211/189; 211/182; 446/111; 446/126; 403/169; 403/173

(58) Field of Search ..... 211/189, 182, 211/191, 194; 446/126, 111; 40/605; 403/169, 173, 217

(56) References Cited

U.S. PATENT DOCUMENTS 3,221,439 A * 12/1965 Schaper ..... 403/169
4,844,566 A * 7/1989 Moore et al. ..... 312/108
5,715,948 A * 2/1998 Hung ..... 211/194
6,112,910 A * 9/2000 Baxter ..... 211/40
6,128,876 A * 10/2000 Nitschke et al. ..... 403/174

* cited by examiner

*Primary Examiner*—Blair M. Johnson
*Assistant Examiner*—Erica B. Harris
(74) *Attorney, Agent, or Firm*—Anderson & Morishita

(57) ABSTRACT

A storage unit assembly kit comprising only two types of rectangular panel pieces are repetitively interlocked to form a storage array for miniature toys. The first type of panel piece includes enlargements at each corner pierced by a first and second aperture extending completely across the plane of the panel. The second type of panel piece, in turn, includes a first and second set of posts extending laterally in the panel plane for insertion in the respective ones of the apertures. The second type of panel piece may also include a bounding barrier generally dimensioned to receive and confine the toy therebetween.

14 Claims, 4 Drawing Sheets

MODULAR STORAGE ASSEMBLY FOR MINIATURE TOY COLLECTION

BACKGROUND OF THE INVENTION

1. Field of the Invention

The present invention relates to storage structures, and more particularly to erectable storage assemblies comprising interlocking common structural units.

2. Description of the Prior Art

Children and adolescents often engage in collecting toys that are either miniature replicas of real articles or small fanciful articles that are part of a set. In each instance there is some desire to maintain the collection in an orderly arrangement, and various storage boxes and carrying cases have been devised to encourage such orderly habits.

While suitable for the purposes intended these prior art carrying cases include few structural interconnections that, in themselves, serve to entertain and exercise a young mind. Simply, the typical storage container often includes no more than a box provided with a cover and some kind of fastening means for its engagement. While there has been some attention to the ornamentation and coloring of these containers, their limited configuration has been quickly relegated to boredom and the container has not had the desired effect. Simply, these containers have not been effective as tools for inviting children to orderly habits.

The complement of toys now vended to the public includes various erector sets, interlocking blocks or other assembly pieces that can be engaged into differing structures. These have been particularly successful, encouraging all sorts of imaginative endeavors with only few, geometrically defined components. A simple, repetitive, structural component has therefore served well both to entertain a child and to develop its manipulative and logical faculties.

In the past, various structural combinations have been devised which, in one way or another, enable construction of storage enclosures. Examples of such combinations can be found in the teachings of U.S. Pat. No. 4,470,647 to Bishoff et al; 4,576,300 to Kedzior; 4,867,327 to Roland, and others. While suitable for the purposes intended, each of the foregoing examples addresses substantial structural concerns, like impact resistance or weight considerations, or other, similar questions, but not the educational or habituating aspects that are to be instilled in children. A structural arrangement that is entertaining to a child, substantially error proof in its assembly and also encouraging in orderly habits is therefore extensively desired, particularly if the same structural arrangement also provides an aesthetic and orderly storage array for toys. It is one such structural arrangement that is disclosed herein.

SUMMARY OF THE INVENTION

Accordingly, it is the general purpose and object of the present invention to provide a set of interlocking components that are unambiguous in their engagement and which, when engaged, form a storage structure for toys.

Other objects of the invention are to provide a set of interlocking structures keyed to interlock into a shelving assembly for miniature toys.

Yet further objects of the invention are to provide a set of interlocking pieces that require some entertaining focus in their assembly while also serving as an organizing structure once combined.

Briefly, these and other objects are accomplished within the present invention by way of two interlocking elements each keyed at the interface with the other for one particular engagement. Preferably one of the elements is in the form of a rectangular platform provided with vertical edge strips along three sides thereof, spaced to confine a miniature container in which a miniature toy is stored. A first set of horizontal engagement posts, separated by a first dimension, extend from one longitudinal edge of the platform in an outward direction. A similar second set of engagement posts, spaced by a second dimension that is different from the first, extend from the opposite platform edge.

The second element is also formed as a rectangular structure with enlargements at each corner. Each of the enlargements is pierced transversely by a first and second cavity conformed to receive the respective ones of the engagement posts. Moreover, each of the enlargements is dimensional in width to the projecting dimension of the engagement posts and if a set of posts is inserted into the piercing cavity from one side, no cavity dimension is left at the other side for receipt of a post from the opposite direction. In this manner, the geometric alignment selection of the first element relative to the second element directs the remaining assembly sequence.

Once the engagement direction between the elements is established the remaining sequence is essentially self-directing. The rows of interlocked first and second elements can then be stacked on top of each other to form a storage structure and to facilitate this stacking the enlargements each include vertical mortise-tenon engagements.

It will be appreciated that the foregoing structural arrangement requires some concentrated focus and logical consideration in the course of its assembly. The task, itself, is therefore compelling to a child. Once assembled, the confining edges of each platform invite further fitting of the miniature toys and even articles like miniature cars. Thus the invention provides for an interest compelling assembly and thereafter the interest compelling use thereof. What results in the end is neatness.

DESCRIPTION OF THE PREFERRED EMBODIMENT

Figure 1:
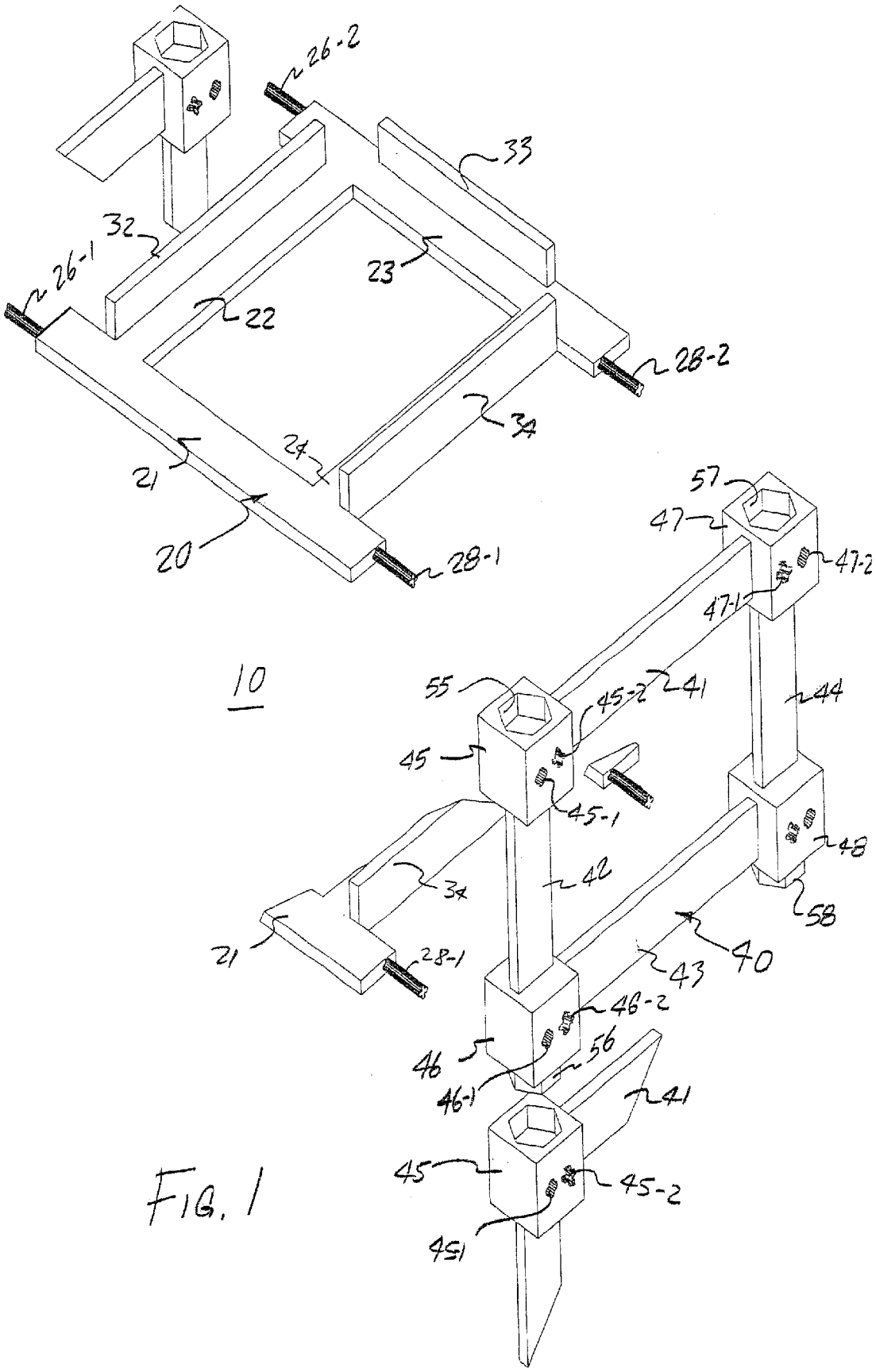
FIG. 1 is a perspective illustration, separated by parts, of the several elements comprising the present invention.
Figure 2:
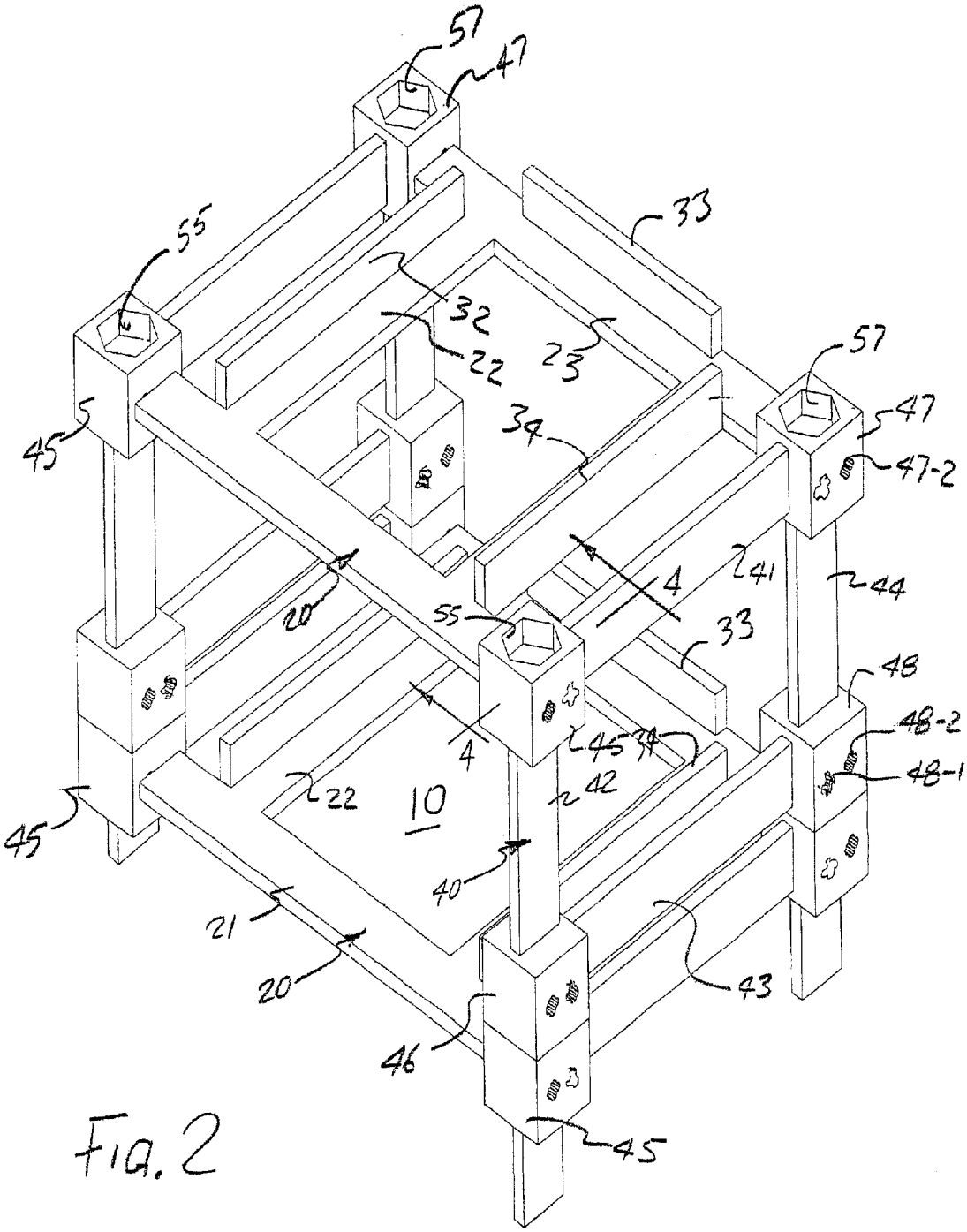
FIG. 2 is yet another perspective illustration of one exemplary arrangement of a storage assembly according to the present invention.
Figure 3:
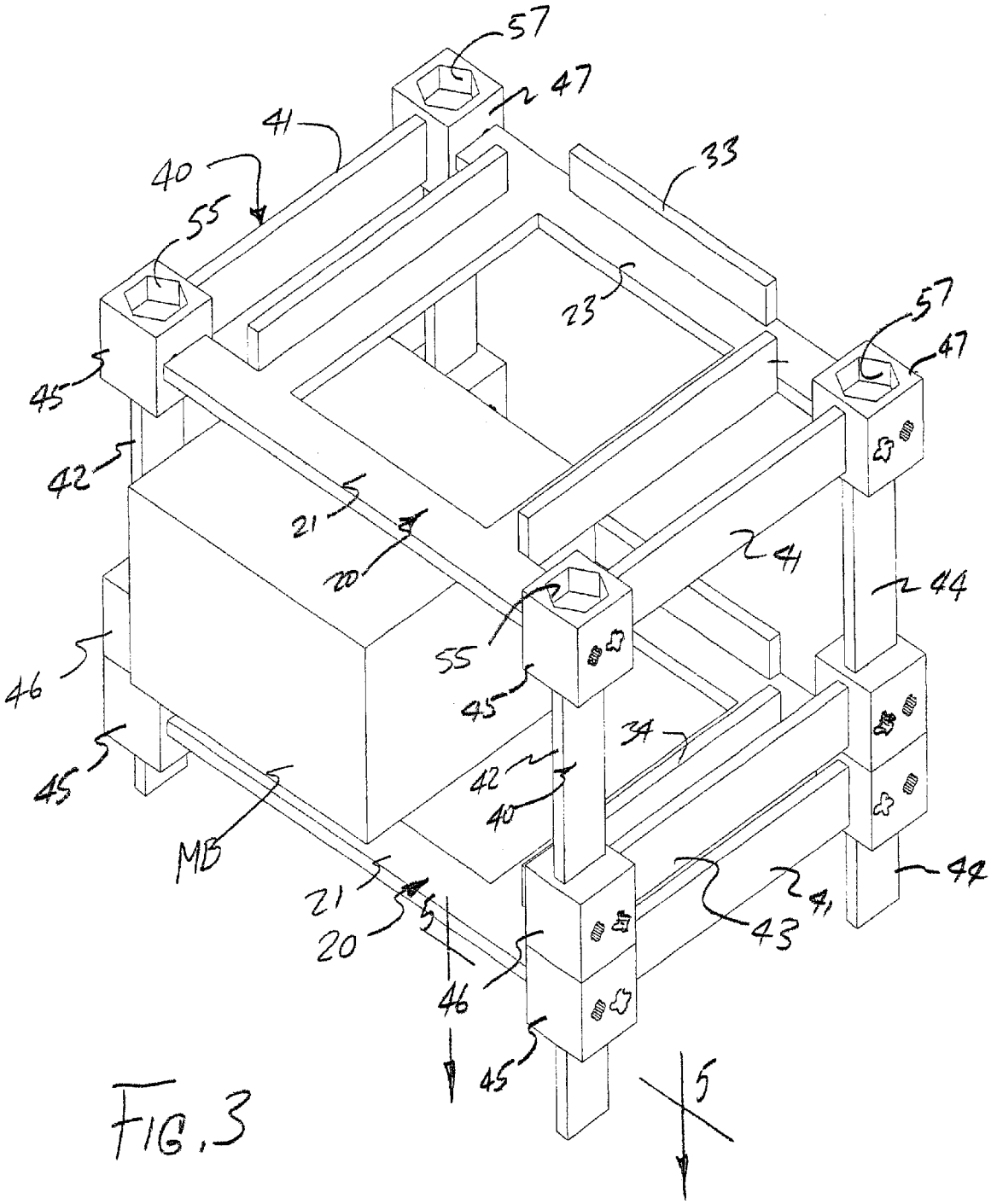
FIG. 3 is a perspective illustration of one portion of the inventive storage assembly in the course of receipt of a stored article.
Figure 4:
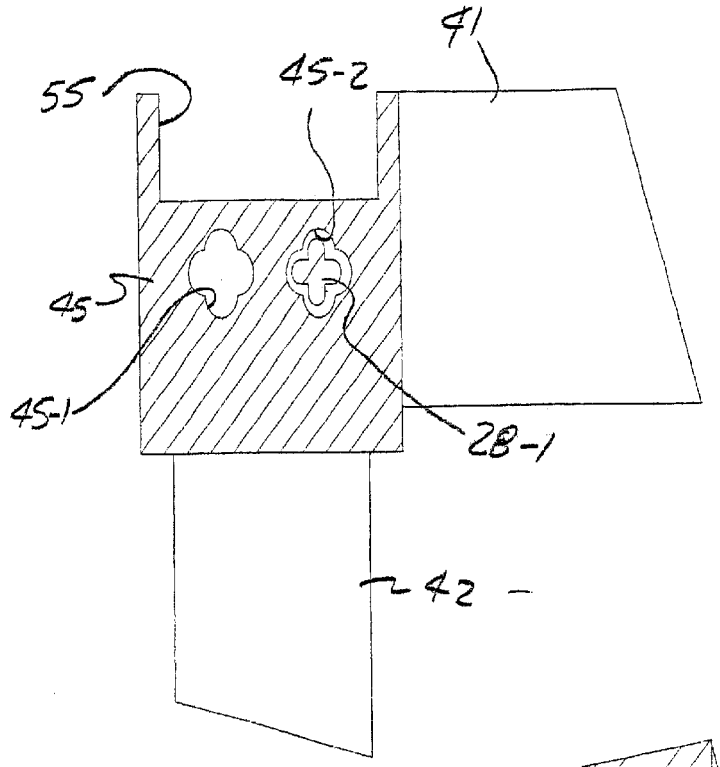
FIG. 4 a sectional view taken along line 4—4 of FIG. 2.
Figure 5:
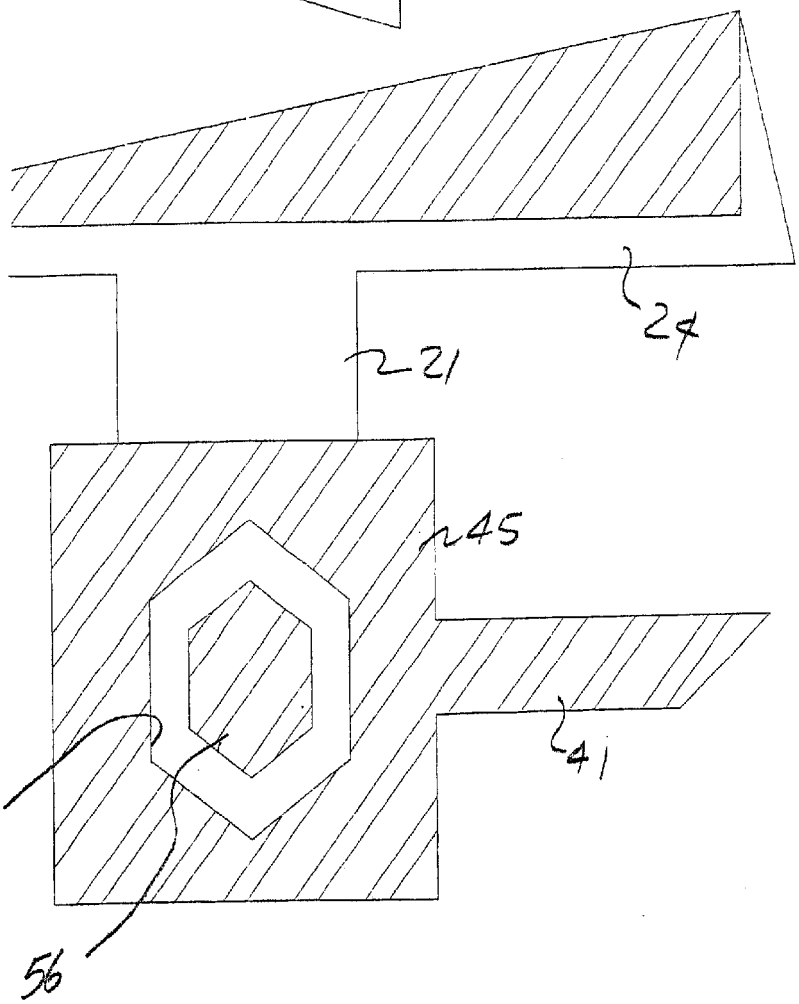
FIG. 5 is yet another sectional view taken along line 5—5 of FIG. 3.

As shown in FIGS. 1–5, the inventive storage array generally designated by the numeral 10 comprises multiple repetitions of an orthogonal engagement between a horizontal assembly element generally shown at 20 and a vertical assembly element 40. Considering first the vertical element 40, a generally rectangular structure is defined by a set of horizontal pieces 41 and 43 extending between vertical pieces 42 and 44. At each corner where the horizontal and vertical pieces intersect a corresponding cubical enlargement is formed shown as upper enlargements 45 and 47 and lower enlargements 46 and 48. Preferably the combination of pieces 41–44 and the enlargements 45–48 are formed as a single molded or cast unit of one of the several known polymeric material structures such as polyvinyl chloride or even polyethylene.

The horizontal element 20 is similarly of a rectangular platform shape defined by a front and a rear strip 21 and 23 joining the ends of two lateral strips 22 and 24. Strips 21 and 23 extend beyond the outer edges of the lateral strips to form spacers from which a first and second set of engagement posts respectively 26-1 and 26-2 and 28-1 and 28-2 extend. Posts 26-1 and 26-2 are separated from each other by a first dimension that is greater than the dimension separating posts 28-1 and 28-2.

Each of the corner enlargements 45–48, in turn, is pierced with a pair of transverse piercing apertures 45-1, 45-2, 46-1 and 46-2, 47-1 and 47-2 and 48-1 and 48-2, the outer ones of such apertures being separated by the separation dimension between posts 26-1 and 26-2 and the inner ones separated by the dimension between posts 28-1 and 28-2.

In this manner, only one interlocking insertion of the post set in the corresponding apertures is possible and once the insertion is made the whole aperture is filled, precluding insertion from the other side and directing the selection of the other apertures as the only possible insertion option. Accordingly, once a particular insertion mode is selected the selection thereafter determines the rest of the interlocking sequence.

The platform defined by strips 21 through 24 is further bounded along three sides by a set of barriers 32, 33 and 34 each along a corresponding one of the outer edges of strips 22, 23 and 24. These barriers are spaced from each other by a dimension conformed for receipt of a miniature storage box MB or a miniature toy or article MT and therefore provide an attractive receipt cavity 30 therefor. Of course, the barriers are effective only when aligned upwardly and therefore further define the orientation of the assembly. Once thus oriented elements 40 can be vertically interlocked by way of pockets 55 and 57 formed in the upper enlargements 45 and 47 receiving tenons 56 and 58 extending from enlargements 46 and 48.

To provide visual clues for the assembly process, each of the posts 26-1, 26-2, 28-1 and 28-2 may be formed to a fanciful section (illustrated herein as a crossing section) and the corresponding piercing apertures may be similarly shaped. The pockets 55 and 57 and the corresponding tenons 56 and 58 can be of distinctly different fanciful shapes, shown herein as hexagonal sections, to provide visual clues in the assembly process. In this manner, an interesting and challenging assembly sequence devised which, when completed, provides a rugged structure that invites the orderly collection and storage of the miniature toys.

Those skilled in the art will not that only two distinct pieces need to be fabricated. Accordingly, the fabrication and tooling costs are minimized as are the costs of inventory. At the user's end, this limited number of geometric shapes assures an extended period of usefulness, as the assembly process can be continued even after some loss of components. Even at its lowest unit level the assembled structure still invites attempts at fitting articles onto shelves, developing the desired habits and interests in the child.

Obviously many modifications and variations can be effected without departing from the spirit of the invention set out herein. It is therefore intended that the scope of the invention be determined solely by the claims appended hereto.

What is claimed is:

1. A storage unit assembly kit, comprising:

a first generally rectangular assembly panel defined by a pair of horizontal strips extending between a pair of vertical strips, the juncture of each said horizontal and vertical strip being formed as an enlargement provided with a first and second piercing aperture extending therethrough;

a second generally rectangular assembly panel defined by a pair of longitudinal strips extending between a pair of transverse strips including a first pair of transversely directed posts extending distally from one end of said transverse strips along one of said longitudinal strips and a second pair of transversely directed posts extending distally from the other end of said transverse strips and aligned in a direction generally opposite to the direction of said first pair of posts;

said first pair of posts being separated by a dimension generally equal to a separating dimension between said first piercing apertures; and said second pair of posts being separated by a dimension generally equal to a separating dimension between said second piercing apertures.

2. A storage unit assembly kit according to claim 1, wherein:

said first and second pairs of posts are each formed in section for receiving fit in corresponding ones of said first and second piercing apertures.

3. A storage unit assembly kit according to claim 2, further comprising:

an edge barrier formed along exterior edges of said longitudinal strips and one of said transverse strips of said second panel forms a receiving cavity therebetween conformed for receipt of a miniature toy.

4. A storage unit assembly kit according to claim 3, wherein:

each said enlargement along one of said horizontal strips includes a projection; and each said enlargement along the other one of said horizontal strips includes a recess conformed to receive said projection.

5. A storage unit assembly kit according to claim 1, further comprising:

an edge barrier formed along exterior edges of said longitudinal strips and one of said transverse strips of said second panel forms a receiving cavity therebetween conformed for receipt of a miniature toy.

6. A storage unit assembly kit according to claim 5, wherein:

each said enlargement along one of said horizontal strips includes a projection; and each said enlargement along the other one of said horizontal strips includes a recess conformed to receive said projection.

7. A storage unit assembly kit according to claim 6, wherein:

each said enlargement is generally formed as a cubical structure having said first and second piercing apertures extending orthogonally therethrough; and each said first and second post is of a length substantially equal to the length of said first and second piercing cavities.

8. An assembly for forming an array of storage cavities, comprising:

a first and second generally rectangular assembly panel each defined by a pair of longitudinal strips extending between a pair of transverse strips, the juncture of each said longitudinal and transverse strip of said first panel being formed as an enlargement provided with a first and second piercing aperture extending therethrough, and said second panel including a first pair of transversely directed posts extending distally from one end of said transverse strips along one of said longitudinal strips and a second pair of transversely directed posts extending distally from the other end of said transverse strips and aligned in a direction generally opposite to the direction of said first pair of posts;

wherein said first pair of posts being separated by a dimension generally equal to a separating dimension between said first piercing apertures and said second pair of posts being separated by a dimension generally equal to a separating dimension between said second piercing apertures.

9. An assembly for forming an array of storage cavities according to claim 8, wherein:

said first and second pairs of posts are each formed in section for receiving fit in corresponding ones of said first and second piercing apertures.

10. An assembly for forming an array of storage cavities according to claim 9, further comprising:

an edge barrier formed along exterior edges of said longitudinal strips and one of said transverse strips of said second panel forms a receiving cavity therebetween conformed for receipt of a miniature toy.

11. An assembly for forming an array of storage cavities according to claim 10, wherein:

each said enlargement along one of said longitudinal strips includes a projection; and each said enlargement along the other one of said longitudinal strips includes a recess conformed to receive said projection.

12. An assembly for forming an array of storage cavities according to claim 8, further comprising:

an edge barrier formed along exterior edges of said longitudinal strips and one of said transverse strips of second panel forms a receiving cavity therebetween conformed for receipt of a miniature toy.

13. An assembly for forming an array of storage cavities according to claim 12, wherein:

each said enlargement along one of said longitudinal strips includes a projection; and each said enlargement along the other one of said longitudinal strip includes a recess conformed to receive said projection.

14. An assembly for forming an array of storage cavities according to claim 13, wherein:

each said enlargement is generally formed as a cubical structure having said first and second piercing apertures extending orthogonally therethrough; and each said first and second post is of a length substantially equal to the length of said first and second piercing cavities.

* * * * *